US005722095A

United States Patent [19]

Jonas

[11] Patent Number: 5,722,095

[45] Date of Patent: Mar. 3, 1998

[54] TIES AND PROCESSES FOR THE MANUFACTURE THEREOF

[76] Inventor: John Harold Jonas, Oakrise Model Farm, Crockham Hill Edenbridge, Kent TN8 6SR, United Kingdom

[21] Appl. No.: 553,686

[22] PCT Filed: Jun. 9, 1994

[86] PCT No.: PCT/GB94/01246

§ 371 Date: Mar. 13, 1996

§ 102(e) Date: Mar. 13, 1996

[87] PCT Pub. No.: WO94/28748

PCT Pub. Date: Dec. 22, 1994

[30] Foreign Application Priority Data

Jun. 9, 1993 [GB] United Kingdom ..... 9311870

[51] Int. Cl.[6] ..... A41D 25/06

[52] U.S. Cl. ..... 2/146; 2/144

[58] Field of Search ..... 2/146, 144, 152.1, 2/153, 155, 46, 145, 149, 150, 156, 157, 49.1; D2/500, 503, 505, 600, 602, 604, 605, 608, 863, 501, 862

[56] References Cited

U.S. PATENT DOCUMENTS

| | | | |
|---|---|---|---|
| D. 72,665 | 5/1927 | Bowman | D2/863 |
| D. 165,693 | 1/1952 | Mearns | D2/863 |
| D. 352,595 | 11/1994 | Cameron | D2/863 |
| 3,208,081 | 9/1965 | Scully | 2/150 |
| 3,714,669 | 2/1973 | Vorbau | 2/46 |
| 3,735,420 | 5/1973 | New | 2/150 |
| 3,833,937 | 9/1974 | Taylor | 2/46 |
| 4,829,601 | 5/1989 | Spanier | 2/49.1 |

*Primary Examiner*—Gloria M. Hale

*Attorney, Agent, or Firm*—Pollock, Vande Sande & Priddy

[57] ABSTRACT

The present invention provides a process for the manufacture of a neck-tie having an irregularly shaped outline defined by a design provided on the front apron of the tie which process comprises in any order the steps of: i) providing a design with an irregularly shaped outline on a fabric; ii) cutting the irregularly shaped outline of the tie from the fabric; and iii) providing means for securing the tie around a wearer's neck. The design may be printed on the fabric for example by a silk screen printing process or by a photographic thermal dye transfer method comprising the steps of: i) obtaining an image of an object to form the design for the front apron of the tie; ii) xerographically producing on a transfer sheet a reverse image of the design in heat transferable dyes; and iii) heat transferring the reverse image from the transfer sheet to a fabric from which the tie will be produced.

6 Claims, 4 Drawing Sheets

TIES AND PROCESSES FOR THE MANUFACTURE THEREOF

FIELD OF THE INVENTION

The present invention relates to neck ties and processes for the manufacture thereof.

BACKGROUND ART

Conventionally, neck ties all have the same generally tubular tapering form, formed by accurate cutting, folding and stitching of the fabric to form the tie. This process is not adapted to forming ties of an unconventional form.

DE-A-2262079 describes ties having an irregularly shaped outline including abstract or symbolic forms or figures.

SUMMARY OF THE INVENTION

In its broadest sense, the present invention provides a neck tie having an irregularly shaped outline.

DE-A-2262079 describes ties having an irregularly shaped outline including abstract or symbolic forms or figures. No process for their manufacture is however disclosed.

According to the present invention there is provided a process for the manufacture of a neck-tie having an irregularly shaped outline defined by a design provided on the front apron of the tie characterised in that the process comprises in any order the steps of:

i) providing a design with an irregularly shaped outline on a fabric;

ii) cutting the irregularly shaped outline of the tie from the fabric; and iii) providing means for securing the tie around a wearer's neck.

The process may comprise printing a design onto a fabric and cutting the design of the tie from the excess fabric. Alternatively, the fabric may be cut first and the design printed onto the cut fabric.

Typically the printed and cut fabric forms only the front apron of the tie and is then incorporated into a clip-on tie fitting or other neck fitting such as a fabric strip provided with a fastening, such as VELCRO hook and loop fastener. Alternatively, the printed design can be provided with the same general blade-like form as a conventional tie such that when the design is cut-out, the tie can be tied in the same manner as a conventional tie. The design can be provided in a generally blade like form such that the printed and trimmed design forms a completed tie—that is, the knot and blade are printed together.

The printing can be carried out by any conventional means. Silk screen printing and lithographic processes are preferred methods, particularly for large-scale production. Photographic thermal dye transfer methods are alternatives which are particularly ell adapted for producing a single tie from a design. The photographic thermal dye transfer method comprises the steps of obtaining an image to form the design on the front apron of the tie, xerographically producing a reverse image of the design in heat transferable dyes on to a transfer sheet, and heat transferring the reverse image from the transfer sheet to a fabric from which the tie will be produced.

Woven or non-woven fabrics including paper or card are equally suitable. Indeed any printable material is suitable, although particularly suitable are linen, cotton or felt.

The above and other aspects of the present invention will now be illustrated by way of example only with reference to the accompanying drawings in which

DESCRIPTION OF THE PREFERRED EMBODIMENTS

Figure 1:
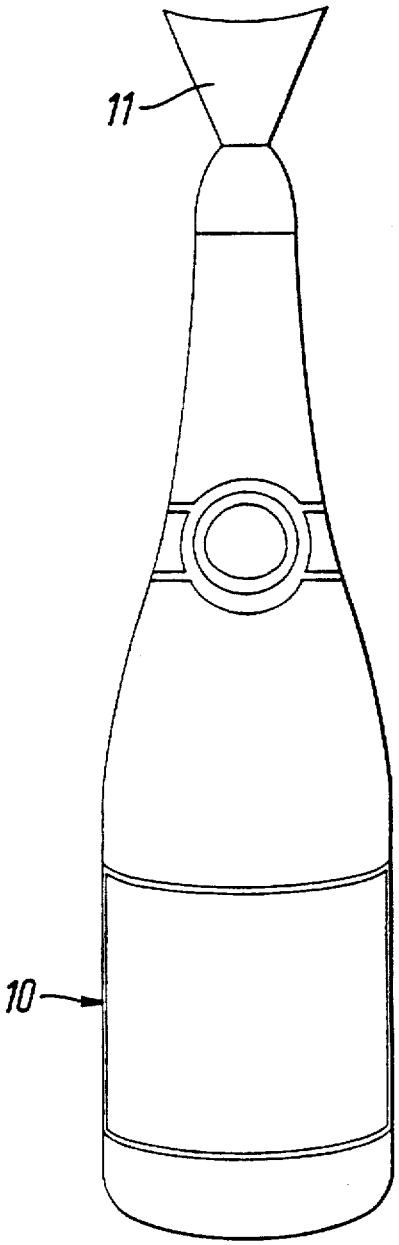
FIGS. 1 to 6 each show an embodiment of a tie produced in accordance with the process of the present invention.
Figure 3:
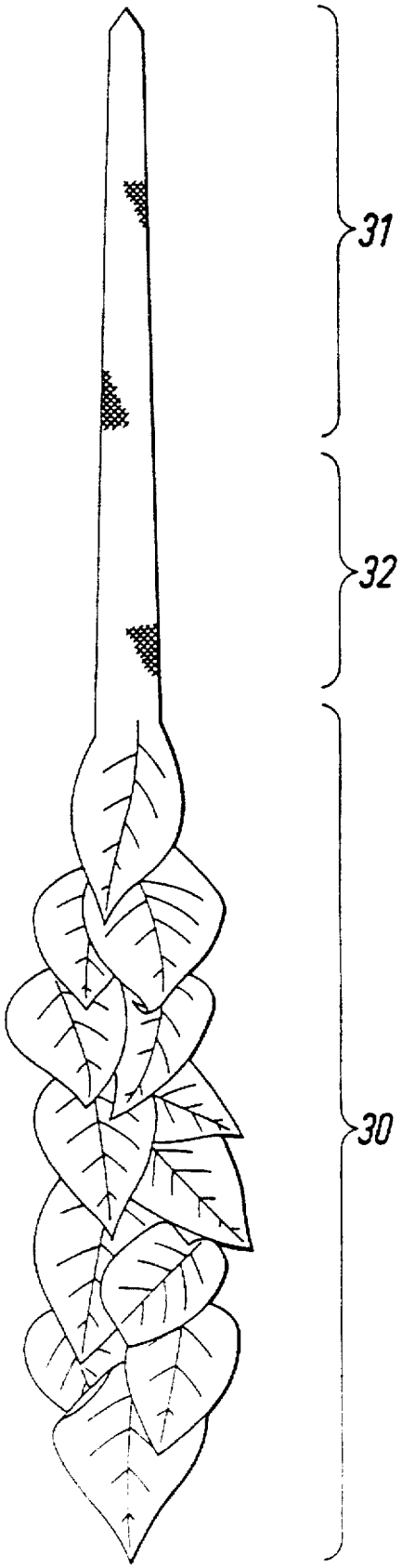
Figure 4:
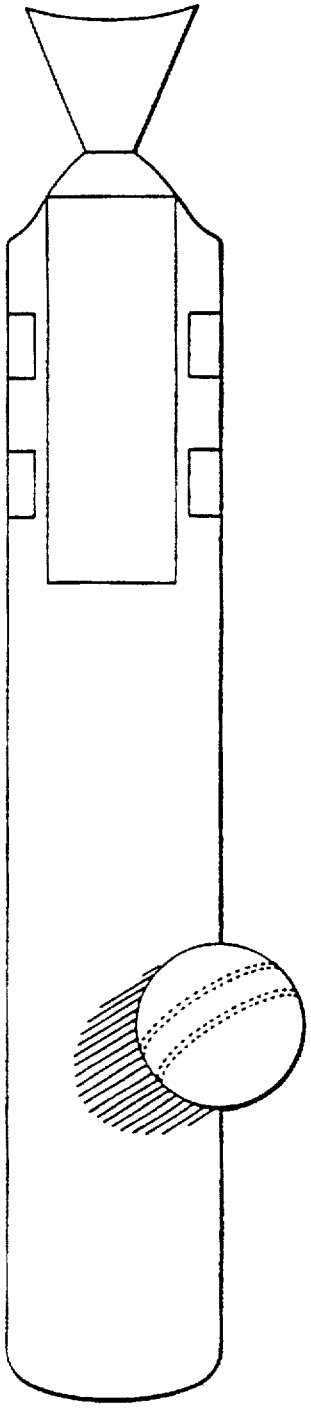
Figure 5:
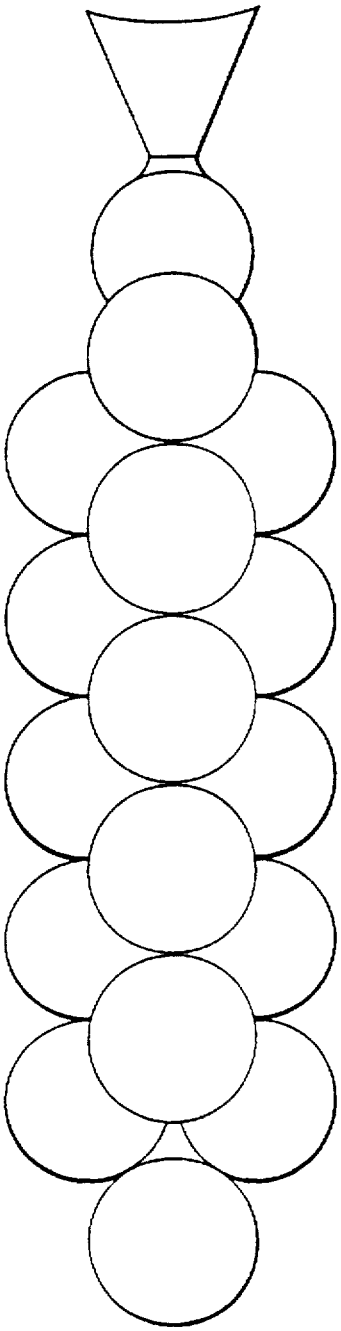
Figure 6:
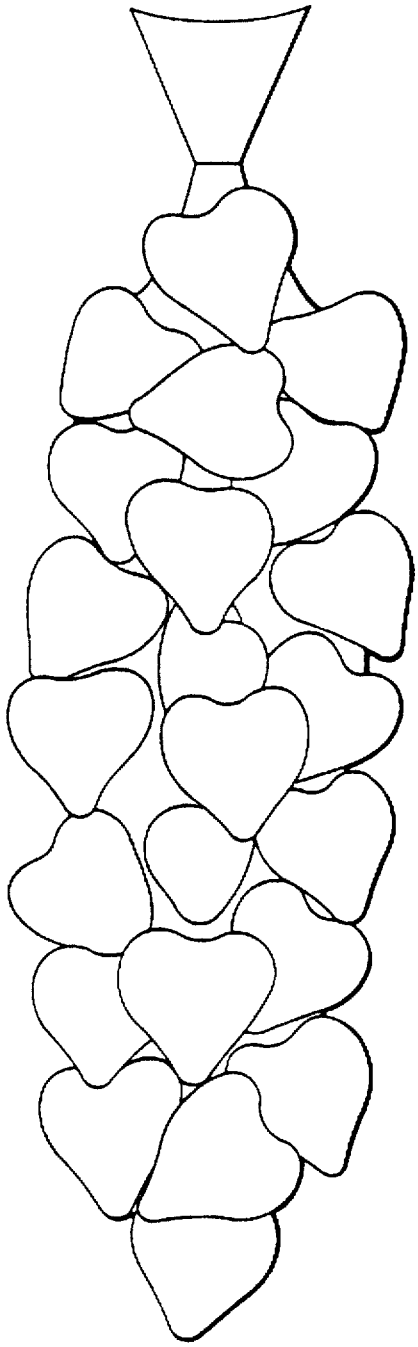

One preferred process for the manufacture of the neck tie in accordance with the present invention includes the following steps. Initially, a photographic image is taken of the object it is desired to make the subject of the tie. The process is highly versatile in the designs which can be made the subject of a tie. Examples are shown in the figures and include a wine or champagne bottle (FIG. 1), an arrangement of fruit such as strawberries (FIG. 2), foliage (FIG. 3), a cricket bat (FIG. 4), an arrangement of pool or snooker balls (FIG. 5), a tennis racket, hearts (FIG. 6) and so on.

Figure 2:
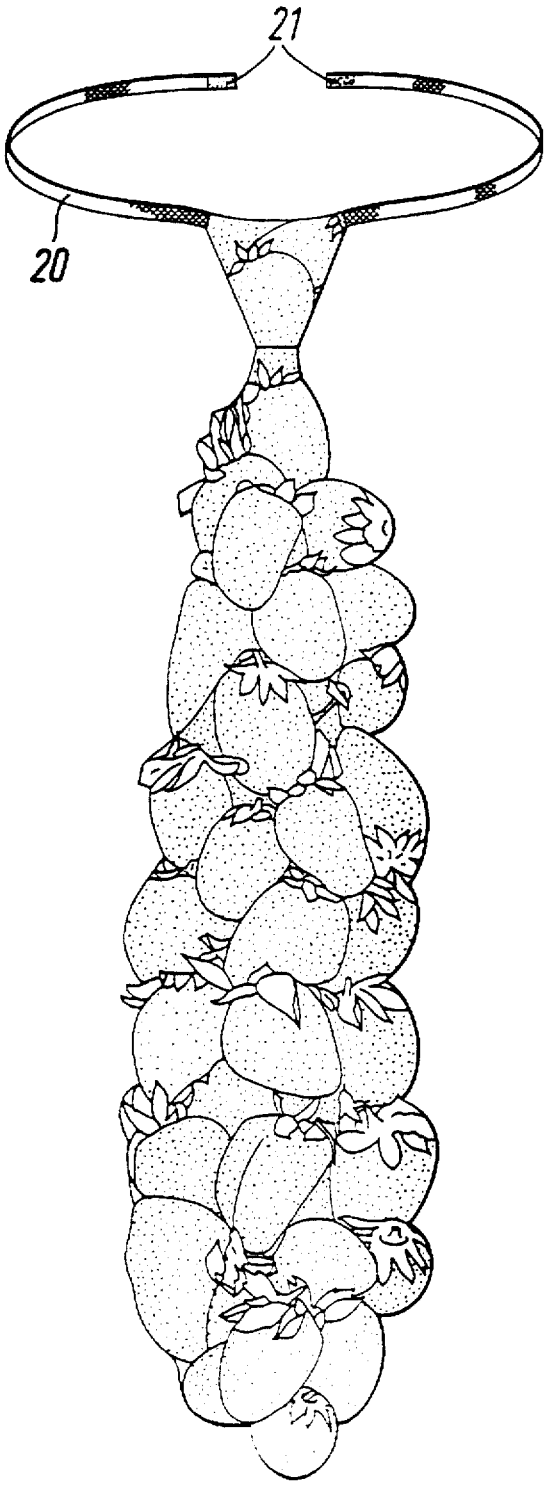

Once a photographic image of the subject matter has been formed it can be xerographically reproduced using a conventional colour photocopier as a reverse image in heat transferable dyes on a transfer sheet. The reverse image is transferred onto a sheet fabric in a conventional manner per se. The excess fabric from around the transferred image is then removed, for example by cutting around the design or by die cutting. The trimmed design (10) can then be incorporated into a conventional clip-on tie fitting (11), as shown in FIGS. 1 and 4 to 6 or affixed to a fabric band (20), as shown in FIG. 2, which can be worn around the neck, in which case, an adjustable fastening (21) such as VELCRO®, hook and loop fastener, may be used or band (20) can be a continuous band of an elasticated material. In the embodiment shown in FIG. 3, the tie is formed with the chosen design on the front apron (30) with an otherwise conventional rear apron (31) and neck end (32) such that the tie is tied and worn in a conventional manner.

Clearly, by producing the reverse image in heat transferable dyes using a conventional photocopier, substantially any design whether originally photographed or otherwise can be reproduced as the tie. Alternatively, the reverse image could be printed directly onto the transfer sheets.

For large scale production, conventional screen printing or lithography may be preferable for obtaining the printed design.

Once printed, the fabric may be laminated with, for example, a sheet plastics material.

In addition to the fabrics already mentioned above, ties in accordance with the present invention can be provided on other sheet material such as paper (particularly suitable for disposable novelty ties), plastics materials or nylon. By way of example, the invention can be used to provide novelty ties, or manufacturers may use the front apron of such ties for promotional material to advertise their products.

I claim:

1. A method for manufacturing a novelty tie comprising:

creating a tie blank comprising a generally elongated length of fabric having a portion resembling a knot located along its length, and a front apron portion extending from said knot portion to an end of said length of fabric;

forming a printed design of an irregular object on said front apron portion;

cutting said elongated length of fabric along first and second edges of said apron portion between said knot portion and said end of said length of fabric material without cutting the remaining portion of said length of fabric, to form irregular edges only on said apron portion which resemble said object; and forming means adjacent said knot portion for securing said tie around a user's neck so that said knot portion and irregular edges of said apron portion which resemble said object are visible.

2. The method for manufacturing a novelty tie according to claim 1 wherein the step of forming means adjacent said knot portion provides an extended portion of said length of fabric which is tied around said user's neck forming a knot in said knot portion.

3. A process according to claim 1 wherein the forming of a printed design is performed by a photographic thermal dye transfer method comprising the steps of:

i) obtaining an image of an object to form the design for the front apron portion of the tie;

ii) xerographically producing on a transfer sheet a reverse image of the design in heat transferable dyes; and iii) heat transferring the reverse image from the transfer sheet to the fabric from which the tie will be produced.

4. A process according to claim 1 wherein the step of forming a printed design is by a screen printing process.

5. A process according to claim 1 wherein the step of forming means for securing forms a clip-on tie fitting on said tie blank.

6. A process according to claim 1 further comprising the step of providing a fabric backing layer on the front apron portion of the tie.

* * * * *